US005879072A

United States Patent [19]

Huang

[11] Patent Number: 5,879,072

[45] Date of Patent: Mar. 9, 1999

[54] TOOL BOX HAVING A LIGHT DEVICE

[76] Inventor: Yung Hsu Huang, No. 10, Lane 38, Li Der Street, Taiping City, Taichung Hsien, Taiwan

[21] Appl. No.: 41,629

[22] Filed: Mar. 13, 1998

[51] Int. Cl.[6] ..... A45C 15/06

[52] U.S. Cl. ..... 362/156; 362/253

[58] Field of Search ..... 362/154, 156, 362/190, 191, 253, 396

[56] References Cited

U.S. PATENT DOCUMENTS 4,855,881 8/1989 Pence ..... 362/156

5,143,440 9/1992 Trampota ..... 362/156

5,685,421 11/1997 Gilmore ..... 362/156 X

*Primary Examiner*—Stephen Husar

[57] ABSTRACT

A tool box includes a base having a number of recesses for receiving tools and a cover pivotally coupled to the base and having an upper groove for receiving a light device. The cover includes a number of projections extended inward of the groove for engaging with and for retaining the light device in place. The light device is a flashlight having a control ferrule. The cover has a notch for receiving the control ferrule and for allowing the control ferrule to be operated when the flashlight is engaged in the groove of the cover.

3 Claims, 3 Drawing Sheets

TOOL BOX HAVING A LIGHT DEVICE

BACKGROUND OF THE INVENTION

1. Field of the Invention

The present invention relates to a tool box, and more particularly to a tool box having a light device.

2. Description of the Prior Art

Typical tool boxes are provided for receiving tools and include no light device and may not be used as a support for a light device.

The present invention has arisen to mitigate and/or obviate the afore-described disadvantages of the conventional tool boxes.

SUMMARY OF THE INVENTION

The primary objective of the present invention is to provide a tool box having a light device for illuminating purposes.

In accordance with one aspect of the invention, there is provided a tool box comprising a base including a plurality of recesses for receiving tools, a cover pivotally coupled to the base, the cover including an upper portion having a groove formed therein, a light device engaged in the groove of the cover, and means for securing the light device in the cover.

The cover includes at least one projection extended inward of the groove for engaging with and for retaining the light device in place.

The light device is a flashlight, the flashlight includes a head and a control ferrule, the cover includes a notch for receiving the control ferrule and for allowing the control ferrule to be operated when the flashlight is engaged in the groove of the cover.

The cover includes an upper portion having a pair of depressions and includes a pair of handles pivotally coupled to the cover, the depressions are provided for receiving the handles.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
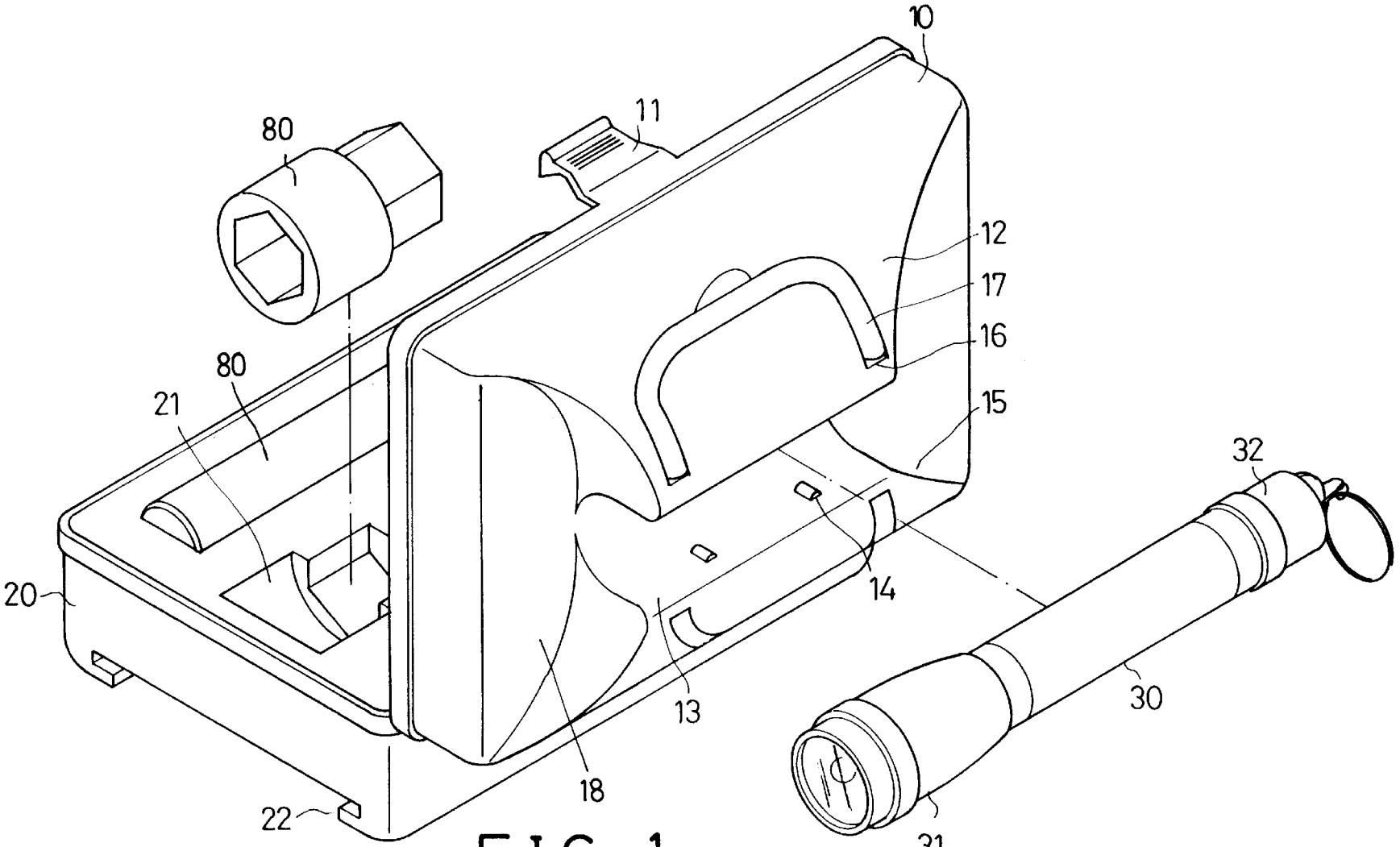
FIG. 1 is an exploded view of a tool box in accordance with the present invention.

Referring to the drawings, a tool box in accordance with the present invention comprises a base 20 having a number of recesses 21 for receiving tools 80, and a cover 10 pivotally secured to the base 20 at a live hinge 28 for allowing the cover 10 to be folded relative to the base 20. The cover 10 includes a latch 11 opposite to the live hinge 28 for securing the cover 10 to the base 20. The base 20 includes a pair of channels 22 formed in the bottom for attaching another tool box.

Figure 2:
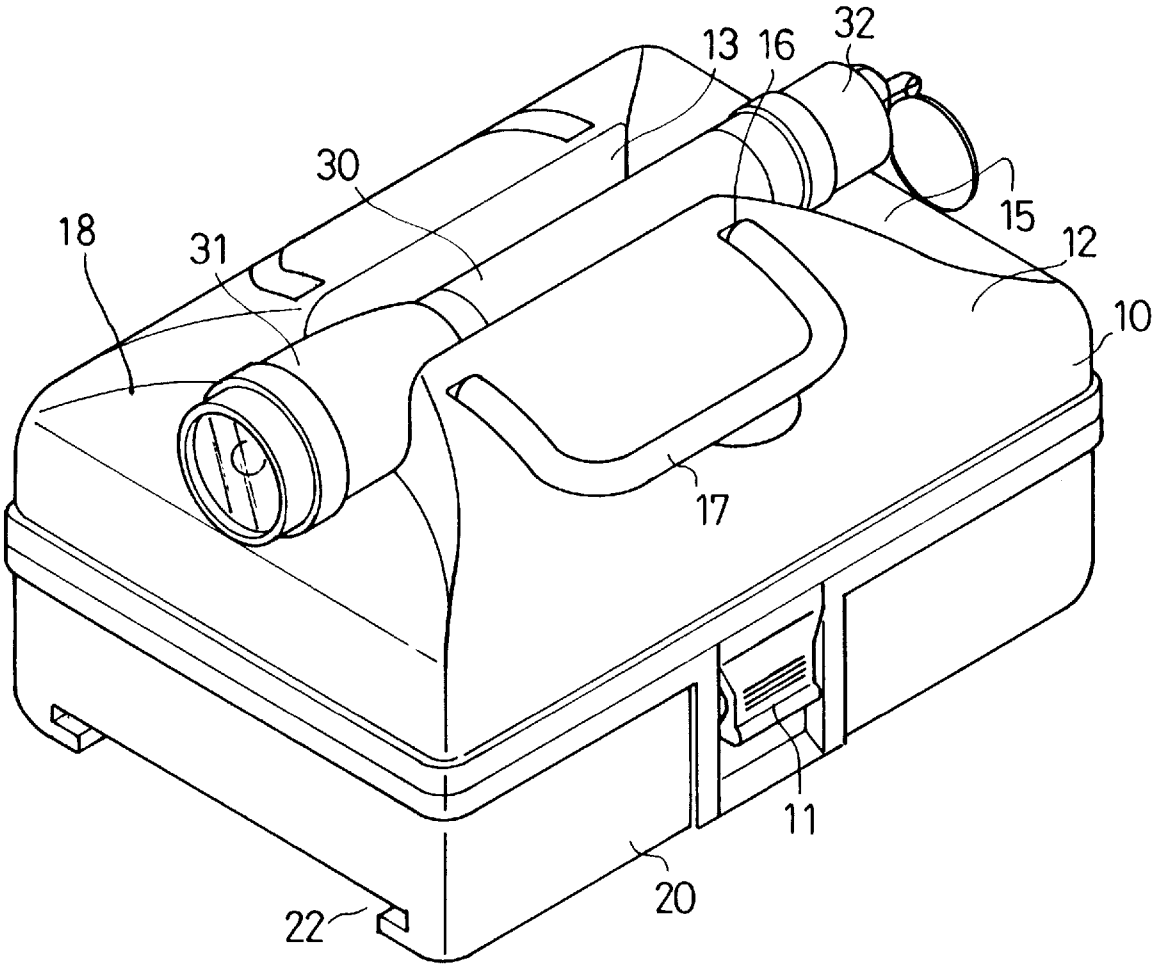
FIG. 2 is a perspective view of the tool box.

The cover 10 includes an upper portion 12 having a groove 13 formed therein for receiving a flashlight 30 or other light device. The flashlight 30 includes a head 31 and a control ferrule 32 for adjusting the light beam of the flashlight 30. The cover 10 includes a number of projections 14 extended inward of the groove 13 for engaging with and for retaining the flashlight 30 in place. The cover 10 also includes a pair of depressions 16 formed in the upper portion 12 for receiving a pair of handles 17. The handles 17 are pivotally coupled to the cover 10 for allowing the handles 17 to be folded upward (FIG. 3) or to be received in the depressions 16 (FIG. 2). The cover 10 further includes a front notch 18 for receiving the head 31 of the flashlight 30 and includes a rear notch 15 for receiving the control ferrule 32 and for allowing the control ferrule 32 to be operated when the flashlight 30 is engaged in the groove 13 (FIG. 2).

Figure 3:
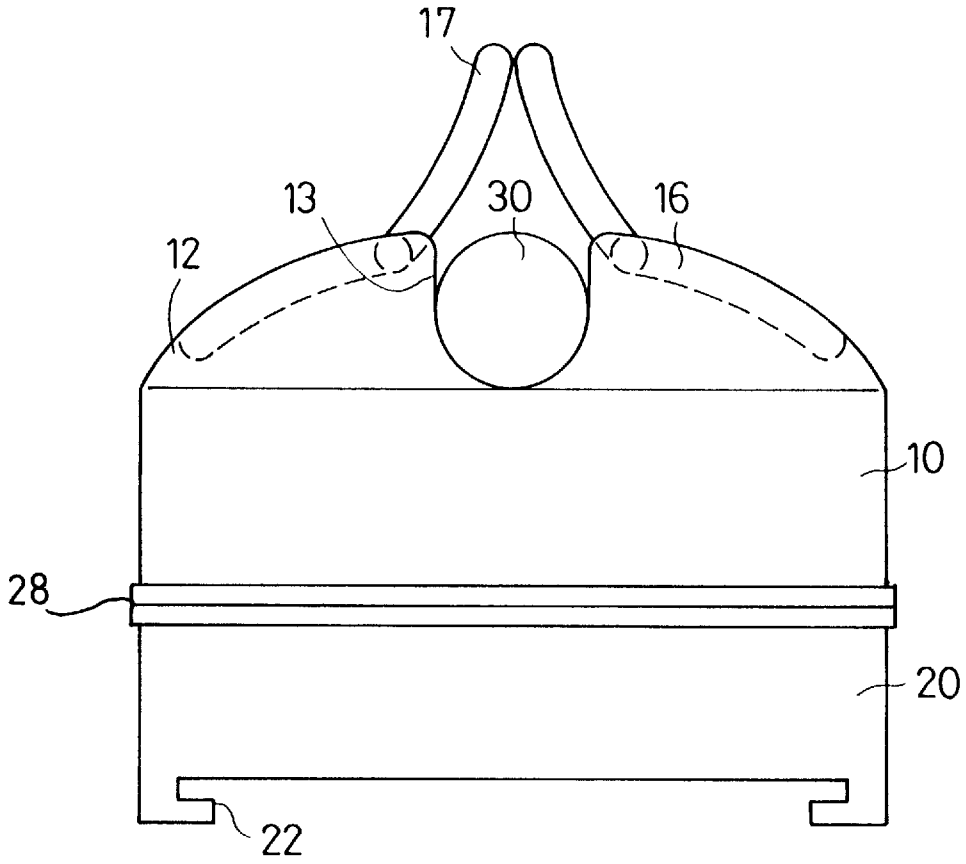
FIG. 3 is a side view of the tool box.

In operation, as shown in FIG. 3, the flashlight 30 may be stably retained in place by the projections 14. In addition, the tool box may be used as a support for supporting the flashlight 30 in place. The flashlight 30 may also be operated when the flashlight 30 is engaged in the groove 13 of the cover 10.

Accordingly, the tool box in accordance with the present invention includes a light device that may be stably retained in place in the tool box and that may be operated when the light device is supported in the tool box.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool box comprising:

a base including a plurality of recesses for receiving tools, a cover pivotally coupled to said base, said cover including an upper portion having a groove formed therein, a light device engaged in said groove of said cover, and means for securing said light device in said cover, said cover including at least one projection extended inward of said groove for engaging with and for retaining said light device in place.

2. A tool box comprising:

a base including a plurality of recesses for receiving tools, a cover pivotally coupled to said base, said cover including an upper portion having a groove formed therein, a light device engaged in said groove of said cover, and means for securing said light device in said cover, said light device being a flashlight, said flashlight including a head and a control ferrule, said cover including a notch for receiving said control ferrule and for allowing said control ferrule to be operated when said flashlight is engaged in said groove of said cover.

3. A tool box comprising:

a base including a plurality of recesses for receiving tools, a cover pivotally coupled to said base, said cover including an upper portion having a groove formed therein, a light device engaged in said groove of said cover, and means for securing said light device in said cover, said cover including an upper portion having a pair of depressions and including a pair of handles pivotally coupled to said cover, said depressions being provided for receiving said handles.

* * * * *